US010210812B2

(12) United States Patent
Kim et al.

(10) Patent No.: US 10,210,812 B2
(45) Date of Patent: Feb. 19, 2019

(54) DISPLAY PANEL HAVING AN IN-PIXEL GATE DRIVER

(71) Applicant: SAMSUNG DISPLAY CO., LTD., Yongin-si, Gyeonggi-do (KR)

(72) Inventors: Se-hyang Kim, Yongin-si (KR); Heejune Kwak, Yongin-si (KR); Kwang-chul Jung, Seongnam-si (KR); Sang-uk Lim, Yongin-si (KR); Junki Jeong, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 320 days.

(21) Appl. No.: 15/099,487

(22) Filed: Apr. 14, 2016

(65) Prior Publication Data

US 2016/0307488 A1 Oct. 20, 2016

(30) Foreign Application Priority Data

Apr. 17, 2015 (KR) ..... 10-2015-0054485

(51) Int. Cl.
*G09G 3/36* (2006.01)
*G09G 3/3266* (2016.01)

(52) U.S. Cl.
CPC ... *G09G 3/3266* (2013.01); *G09G 2300/0408* (2013.01); *G09G 2300/0426* (2013.01); *G09G 2300/0452* (2013.01); *G09G 2300/0465* (2013.01); *G09G 2320/0242* (2013.01); *G09G 2320/043* (2013.01)

(58) Field of Classification Search
CPC .. G09G 3/20; G09G 3/30; G09G 3/36; G09G 3/32
See application file for complete search history.

(56) References Cited

U.S. PATENT DOCUMENTS 7,755,565 B2 * 7/2010 Park ..... G09G 3/3677 345/1.1
2013/0235003 A1 9/2013 Chang et al.
2014/0175977 A1 6/2014 Yoon et al.
2015/0001504 A1 * 1/2015 Kim ..... H01L 27/32 257/40

(Continued)

FOREIGN PATENT DOCUMENTS

KR 10-0973810 B1 8/2010
KR 10-1147100 B1 5/2012
KR 10-2013-0039584 A 4/2013

(Continued)

OTHER PUBLICATIONS

Korean Patent Abstracts for KR 10-2005-0017899 A dated Feb. 23, 2005 Which Corresponds to KR 10-0973810 B1 Listed Above, 1 page.

(Continued)

*Primary Examiner* — Pegeman Karimi
(74) *Attorney, Agent, or Firm* — Lewis Roca Rothgerber Christie LLP

(57) ABSTRACT

There is provided a display panel including a plurality of white subpixels configured to display a white image, a gate line connected with the white subpixels and extended in a row direction, and an in-pixel gate driver including in-pixel elements exclusively in the white subpixels and connected with the gate line to supply a gate signal to the gate line.

17 Claims, 6 Drawing Sheets

(56) References Cited

U.S. PATENT DOCUMENTS

| | | | | |
|---|---|---|---|---|
| 2016/0104423 | A1* | 4/2016 | Park | G09G 3/3233 345/78 |
| 2017/0018220 | A1* | 1/2017 | Takahara | G09G 3/3233 |

FOREIGN PATENT DOCUMENTS

| | | | |
|---|---|---|---|
| KR | 10-2013-0135043 | A | 12/2013 |
| KR | 10-2014-0077702 | A | 6/2014 |

OTHER PUBLICATIONS

Korean Patent Abstracts for KR 10-2006-0133194 A dated Dec. 26, 2006 Which Corresponds to KR 10-1147100 B1 Listed Above, 1 page.

Yoshida et al., "Flexible Flat-Panel Display Designs with Gate Driver Circuits Integrated within the Pixel Area", SID 2014 Digest, pp. 701-704.

* cited by examiner

DISPLAY PANEL HAVING AN IN-PIXEL GATE DRIVER

CROSS-REFERENCE TO RELATED APPLICATION

This application claims priority to and the benefit of Korean Patent Application No. 10-2015-0054485, filed Apr. 17, 2015, in the Korean Intellectual Property Office, the entire content of which is hereby incorporated by reference.

BACKGROUND

The inventive concepts described herein relate to a display panel with a thin bezel.

Flat display panels are roughly classified into either light emitting panels or light receiving panels. Light emitting panels include plasma display panels, organic light emitting panels (OLED panels), and so on.

An OLED panel includes an organic light emitting device formed of an anode, an organic light emitting layer, and a cathode. Such an organic light emitting device is illuminated by energy generated when excitons arising from combinations with electrons and holes go to a ground state from an excited state in the organic light emitting layer, and this illumination is used for displaying an image on the OLED panel.

An OLED panel usually includes a plurality of pixels and a gate driver for driving the pixels. A general gate driver is provided into a non-display area adjacent to a display area. The display panel is designed to have a bezel width corresponding to the non-display area.

SUMMARY

One aspect of embodiments of the inventive concept is directed to provide a display panel with a thin bezel width.

According to an embodiment of the present invention, there is provided a display panel including: a plurality of white subpixels configured to display a white image; a gate line connected with the white subpixels and extended in a row direction; and an in-pixel gate driver including in-pixel elements exclusively in the white subpixels and connected with the gate line to supply a gate signal to the gate line.

In an embodiment, the in-pixel elements are in a device embedded area of each of the white subpixels, and each of the white subpixels includes a white pixel electrode in an electrode area of each of the white subpixels, the electrode area not overlapping with the device embedded area.

In an embodiment, each of the white subpixels includes a device driving circuit in a circuit area of each of the white subpixels, and the electrode area does not overlap with the device embedded area.

In an embodiment, the gate line includes first to n'th gate lines, and the in-pixel gate driver includes first to n'th in-pixel gate driver units that supply corresponding gate signals of the gate signal to the first to n'th gate lines, where n is a natural number larger than or equal to 2.

In an embodiment, each of the first to n'th in-pixel gate driver units is includes p members, where p is a natural number larger than or equal to 2.

In an embodiment, the in-pixel gate driver is includes a plurality of in-pixel gate driver units provided along the row direction.

In an embodiment, each of the plurality of in-pixel gate driver units include members corresponding to k subpixels in the row direction, where k is a natural number.

In an embodiment, k is determined from characteristics of the gate line.

In an embodiment, the gate line includes a first gate line and a second gate line adjacent to the first gate line in a column direction, and the in-pixel gate driver is between the first and second gate lines, and is configured to use a first gate signal of the gate signal to generate a second gate signal of the gate signal, the first and second signals being received from the first and second gate lines, respectively.

In an embodiment, the in-pixel elements include a first transistor connected with the first gate line and configured to supply the first gate signal.

In an embodiment, the display panel further includes an off-voltage line configured to supply an off-voltage, wherein the in-pixel element includes a second transistor connected with the off-voltage line and configured to supply the off-voltage from the off-voltage line to the second gate line.

In an embodiment, the display panel further includes: a positive clock line configures to supply a positive clock signal; and a negative clock line configured to supply a negative clock signal having a phase reverse that of the positive clock, wherein the in-pixel element includes a third transistor that includes a source electrode connected with the positive clock line and a drain electrode connected with the second gate line, and wherein the second transistor includes a gate electrode connected with the negative clock line, a source electrode connected with the off-voltage line, and a drain electrode connected with the second gate line.

In an embodiment, the off-voltage line is parallel with the row direction, and the positive and negative clock lines are parallel with the column direction.

In an embodiment, the display panel further includes a plurality of pixel groups, wherein each of the pixel groups include the white subpixel and a plurality of pixels, each of the pixels having a plurality of color subpixels to display a color image.

In an embodiment, a left pixel and a right pixel of the plurality of pixels are at opposite sides of the white subpixel.

In an embodiment, the left pixel and the right pixel of each of the pixel groups are configured to share the white subpixel of each of the pixel groups.

In an embodiment, each of the left and right pixels includes a red subpixel, a green subpixel, and a blue subpixel respectively displaying a red image, a green image, and a blue image.

Because a display panel according to an embodiment of the inventive concept includes an in-pixel gate driver, it may be capable of reducing a bezel width of the display panel. Additionally, in-pixel elements forming the in-pixel gate driver are only disposed in white subpixels. Therefore, it may be accomplishable to implement an in-pixel gate driver without wasting an opening rate of other color subpixels. Additionally, as an opening rate of the white subpixels decreases by the in-pixel elements, contribution of the white subpixels may be reduced to result in preventing an image quality from degrading due to the white subpixels.

DETAILED DESCRIPTION

Figure 1:
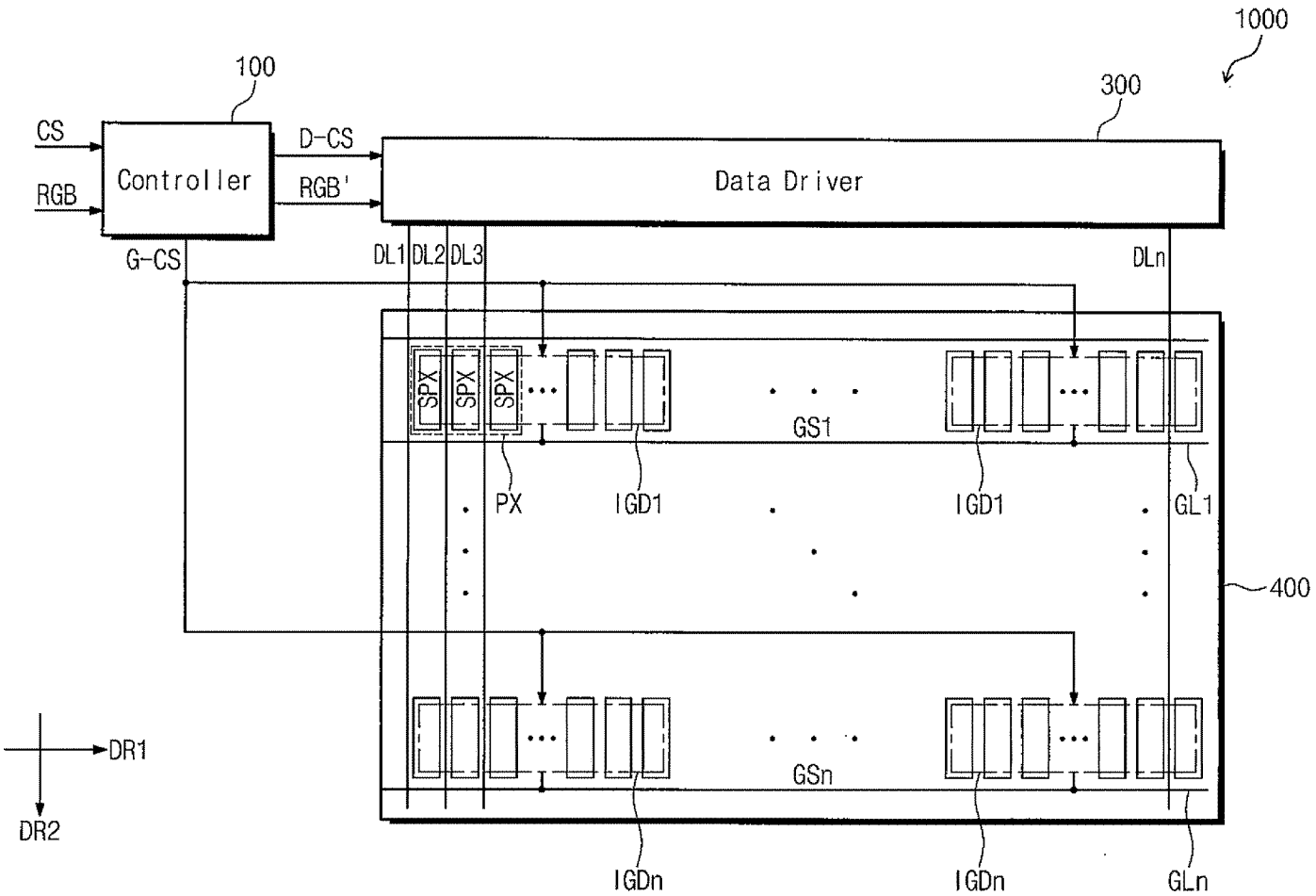
FIG. 1 is a plan view schematically illustrating a display apparatus according to an embodiment of the inventive concept.

Aspects and features of the inventive concept, and ways for accomplishing them will be apparent from embodiments described in detail hereinafter in conjunction with the accompanying drawings. The inventive concept, however, may be embodied in various different forms, and should not be construed as being limited only to the illustrated embodiments, and rather includes all of modifications, equivalents, or substitutions therein. Other descriptions out of the scope of the inventive concept will not be included in this specification for convenience of explanation, and unless otherwise noted, the same reference numerals denote the same elements throughout the specification and the attached drawings.

FIG. 1 is a plan view schematically illustrating a display apparatus according to an embodiment of the inventive concept.

Referring to FIG. 1, a display apparatus 1000 according to an embodiment of the inventive concept may include a display panel 400 to display an image, and a panel driver to drive the display panel 400. The panel driver may include a gate driver, a data driver 300, and a controller 100 to control the gate driver and the data driver 300.

In an embodiment, the gate driver may be implemented by an in-pixel gate driver. The in-pixel gate driver, for example, may include a plurality of first to n'th in-pixel gate driver units IGD1~IGDn.

The controller 100 may receive a plurality of control signals CS and input image data RGB, which include information about an image to be displayed. The controller 100 may convert the input image data RGB into output image data RGB' for interface specification of the data driver 300 and the display panel 400, and provide the output image data RGB' to the data driver 300. Additionally, the controller 100 may generate a data control signal D-CS (e.g., output start signal, vertical start signal, etc.) and a gate control signal G-CS from the plural control signals CS. The data control signal D-CS may be provided to the data driver 300, and the gate control signal G-CS may be provided to the first to n'th in-pixel gate driver units IGD1~IGDn.

The first to n'th in-pixel gate driver units IGD1~IGDn may respectively output first to n'th gate signals GS1~GSn in response to the gate control signal G-CS, which is provided from the controller 100.

The data driver 300 may convert the output image data RGB' into data voltages in response to the data control signal D-CS, which is provided from the controller 100. The data voltages output from the data driver 300 may be supplied into the display panel 400.

The display panel 400 may include a plurality of gate lines GL1~GLn, a plurality of data lines DL1~DLm, and a plurality of subpixels SPX.

The gate lines GL1~GLn may be extended along a first direction DR1 and arranged in parallel along a second direction Dr2. The data lines DL1~DLm may be insulated from the gate lines GL1~GLn, as well as crossing the gate lines GL1~GLn. For example, the data lines DL1~DLm may be extended along the second direction DR2 and arranged in parallel along the first direction DR1. The first and second directions DR1 and DR2 may be respectively parallel with row and column directions, which cross each other.

The subpixels SPX may display one of primary colors such as red, green, and blue. Colors displayable by the subpixels SPX are not restricted to red, green, and blue. The subpixels SPX may display various suitable colors such as yellow, cyan, and magenta, as well as red, green, and blue.

The subpixels SPX may form pixels PX. In an embodiment, three subpixels SPX may form one pixel PX. Without being restricted hereto, each pixels PX may be formed of two, four, or more subpixels SPX.

Each pixel PX may be an element for displaying a unit image. The number of the pixels built in the display panel 400 may determine resolution of the display panel 400. The pixels PX may be arranged in a form of matrix along the first and second directions DR1 and DR2.

The subpixels SPX may be connected to corresponding data lines DL1~DLm and corresponding gate lines GL1~GLn.

The first to n'th in-pixel gate driver units IGD1~IGDn may respectively connect with the gate lines GL1~GLn and apply the first to n'th gate signals GS1~GSn to the gate lines GL1~GLn.

In-pixel elements IPE (see, e.g., FIG. 3) respectively forming the first to n'th in-pixel gate driver units IGD1~IGDn may be distributed in the subpixels SPX. Accordingly, an area where the first to n'th in-pixel gate driver units IGD1~IGDn are disposed may be overlaid with a pixel area where the subpixels SPX are disposed. In an embodiment, the in-pixel elements IPE respectively forming the first to n'th in-pixel gate driver units IGD1~IGDn may be distributed in the subpixels SPX, a number q of which are arranged on the same row (where q is a natural number). In an embodiment, q may be 22. This will be described in further detail later.

Additionally, each of the first to n'th in-pixel gate driver units IGD1~IGDn may be provided in number of p (where p is a natural number larger than or equal to 2), that is, may constitute p members. In this configuration, each of the members of the n-pixel gate driver units IGD1~IGDn, which are provided on the same row, may correspond to k subpixels SPX (where k is a natural number larger than or equal to 1). For example, the first in-pixel gate drivers unit IGD1 may be provided in number of 4 along the first direction DR1 and the n'th in-pixel gate driver units IGDn may be also provided in number of 4 along the first direction DR1.

The numbers p and k may be determined in accordance with the characteristics respective to the gate lines GL1~GLn. For example, each characteristics of the gate lines GL1~GLn may conform with each impedance of the gate lines GL1~GLn. For example, as the impedance of the gate lines GL1~GLn becomes larger, the number p increases while the number k decreases.

The gate driver may be generally disposed in the circumference of an area in which the subpixels SPX are disposed, and a bezel width of the display panel 400 may be determined in accordance with a width of the circumference.

As the gate driver is formed by using the in-pixel gate driver units, it may be unnecessary to use an additional area for disposing the gate driver because the members of the in-pixel gate driver units are distributed in the subpixels. Therefore, it may be allowable to reduce a bezel width of the display panel 400.

Figure 2:
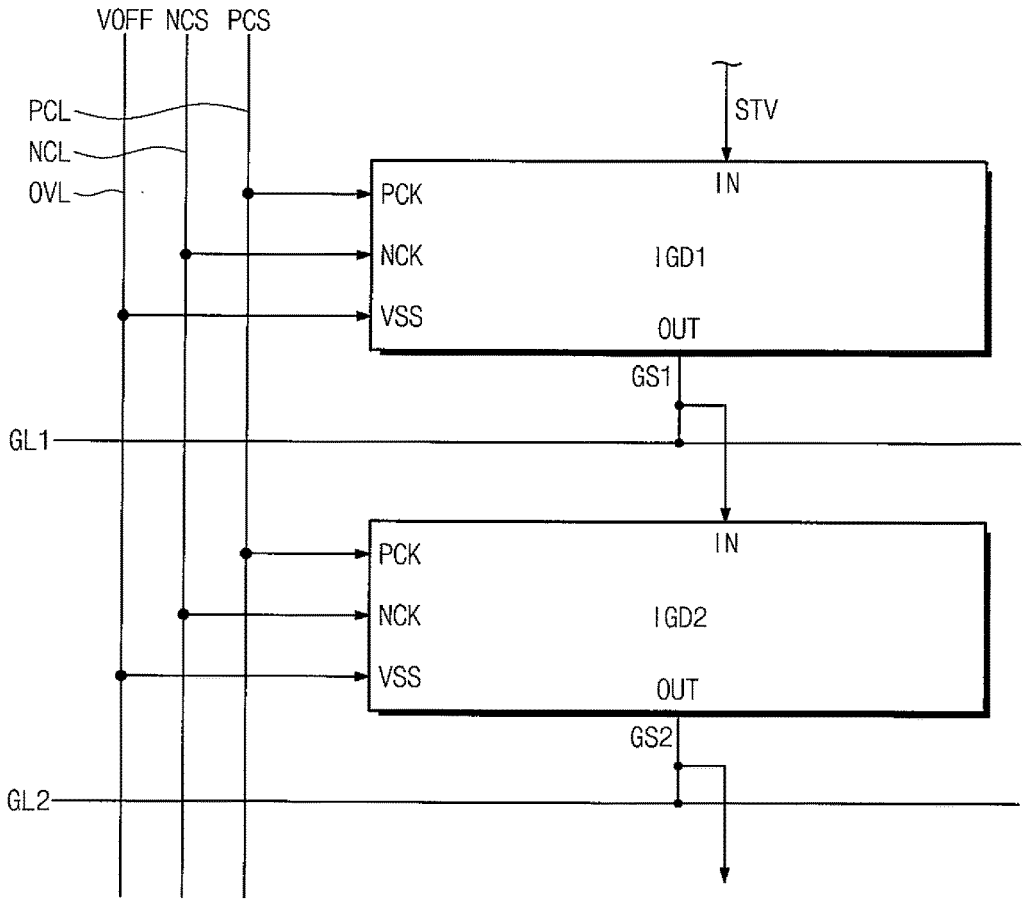
FIG. 2 is a schematic view illustrating an operation of the in-pixel gate driver unit shown in FIG. 1.

FIG. 2 is a schematic view illustrating an operation of the in-pixel gate driver unit shown in FIG. 1.

For convenience of description, FIG. 2 illustrates one of the first in-pixel gate driver units IGD1 and one of the second in-pixel gate driver units IGD2 in the first to n'th in-pixel gate driver units IGD1~IGDn. The rest of the in-pixel gate driver units may be dependently connected to each other in the same manner as the first and second in-pixel gate driver units IGD1 and IGD2, which will be described in further detail below.

Each of the first in-pixel gate driver unit IGD1 and the second in-pixel gate driver unit IGD2 may include positive and negative clock node PCK and NCK, an off-voltage node Vss, a gate signal output node OUT, and a driving start signal input node IN.

The positive and negative clock nodes PCK and NCK corresponding to the first and second in-pixel gate drivers IGD1 and IGD2 may receive positive and negative clock signals PCS and NXS, which are inverse of each other in phase. The off-voltage nodes VSS corresponding to the first and second in-pixel gate drivers IGD1 and IGD2 may receive an off-voltage VOFF.

The positive and negative clock signals PCS and NCS may have high and low levels, which are periodically provided thereto. The high level may correspond to a turn-on voltage to turn on switching transistors of the subpixels SPX (see, e.g., FIG. 1). The low level may correspond to a turn-off voltage to turn off the switching transistors of the subpixels SPX.

The positive and negative clock signals PCS and NCS may be supplied respectively through a positive clock line PCL and a negative clock line NCL. The off-voltage VOFF may be supplied through an off-voltage line OVL.

The first in-pixel gate driver unit IGD1 may begin to drive by a vertical start signal STV, which is received through the driving start signal input node IN. The vertical start signal STV may define one frame period. The first in-pixel gate driver unit IGD1 may output the first gate signal GS1 through the gate signal output node OUT. Additionally, the first in-pixel gate driver unit IGD1 may output a second driving start signal to begin the second in-pixel gate driver unit IGD2. In an embodiment, the first gate signal GS1 may be provided as the second driving start signal to the second in-pixel gate driver unit IGD2.

The first in-pixel gate driver unit IGD1 may output a high level of the positive clock signal PCS as a part of the first gate signal GS1 through the gate signal output node OUT during a first horizontal period of the frame period. Additionally, the in-pixel gate driver unit IGD1 may output the off-voltage VOFF as a part of the first gate signal GS1 through the gate signal output node OUT during the rest of the first horizontal period of the frame period. Then, the first gate signal GS1 may be at the high level during the first horizontal period and at the low level during the rest of the first horizontal period.

The second in-pixel gate driver unit IGD2 may begin to drive in response to the second driving start signal, which is received through the driving start signal input node IN. As aforementioned, the second driving start signal may be, for example, the first gate signal GS1.

The second in-pixel gate driver unit IGD2 may output the second gate signal GS2 through the gate signal output signal OUT. Additionally, the second in-pixel gate driver unit IGD2 may output a third driving start signal to begin a third in-pixel gate driver unit. In an embodiment, the second gate signal GS2 may be provided as the third driving start signal to the third in-pixel gate driver unit.

The second in-pixel gate driver unit IGD2 may output a high level of the negative clock signal NCS as a part of the second gate signal GS2 through the gate signal output node OUT during a second horizontal period of the frame period. Additionally, the second in-pixel gate driver unit IGD2 may output the off-voltage VOFF as a part of the second gate signal GS2 through the gate signal output node OUT during the rest of the second horizontal period of the frame period. Then, the second gate signal GS2 may be at the high level during the second horizontal period, and at the low level during the rest of the second horizontal period.

Figure 3:
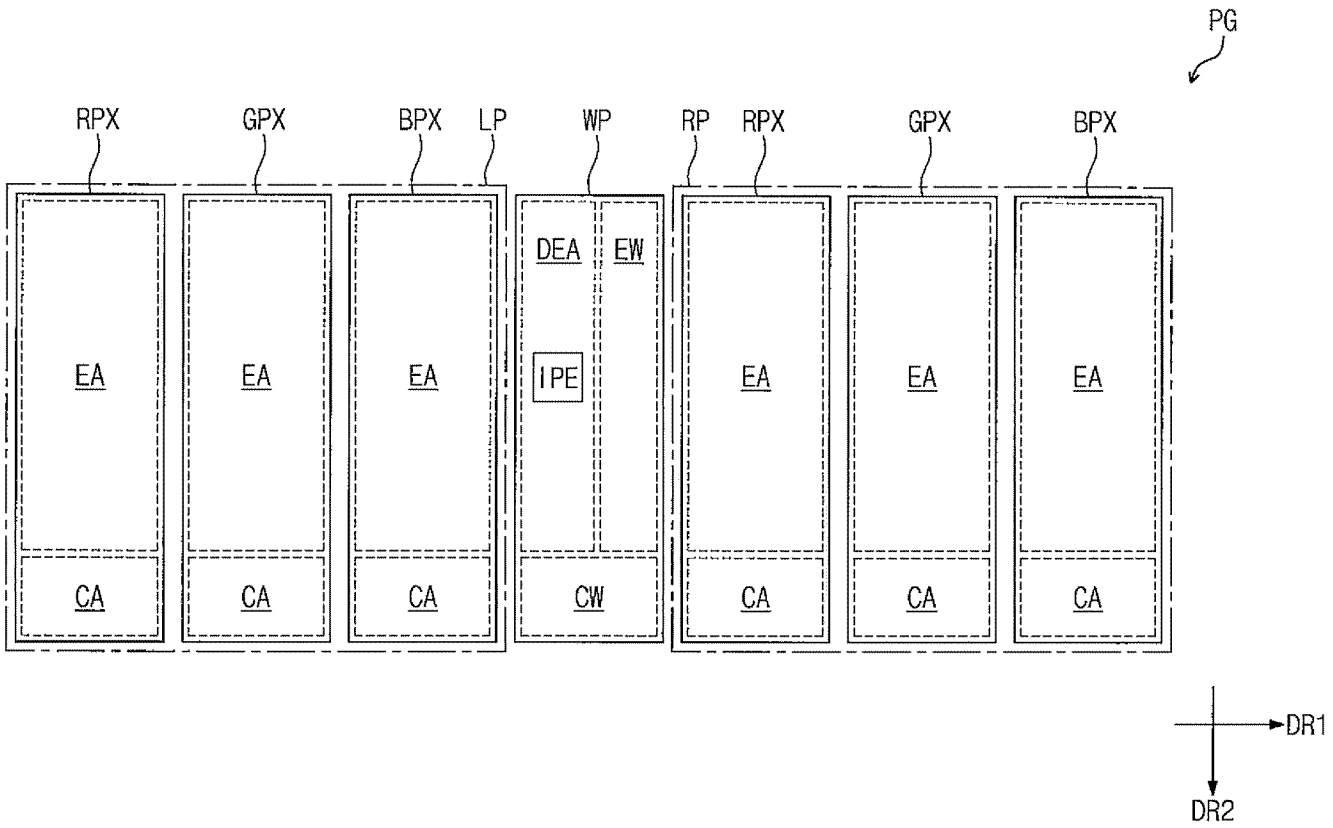
FIG. 3 is an enlarged plan view illustrating a part of the display panel shown in FIG. 1.

FIG. 3 is an enlarged plan view illustrating a part of the display panel shown in FIG. 1.

Referring to FIG. 3, the display panel 400 (e.g., shown in FIG. 1) may include a plurality of pixel groups PG. FIG. 3 shows a representative one of the plurality of pixel groups PG.

The pixel group PG may include, for example, a left pixel LP, a white subpixel WP, and a right pixel RP. The left pixel LP and the right pixel RP may be arranged adjacent to the left and right sides of the white subpixel WP.

Each of the left pixel LP and the right pixel RP may include a red subpixel RPX, a green subpixel GPX, and a blue subpixel BPX. The red, green, blue, and white subpixels RPX, GPX, BPX, and WP are subpixels, among the subpixels SPC (e.g., shown in FIG. 1), which display red, green, blue, and white images, respectively.

The red subpixel RPX, the green subpixel GPX, and the blue subpixel BPX may display a green image, a red image, and a blue image, respectively. The red subpixel RPX, the green subpixel GPX, and the blue subpixel BPX may include a red emitting material, a green emitting material, and a blue emitting material to generate red light, green light, and blue light respectively. The red emitting material, the green emitting material, and the blue emitting material may be, for example, organic emitting materials.

Additionally, the white subpixel WP may display a white image. The white subpixel WP may include, for example, a white emitting material to generate white right. The white emitting material may be, for example, an organic emitting material.

Additionally, without being restricted hereto, the red subpixel RPX, the green subpixel GPX, and the blue subpixel BPX may all include the white emitting material and respectively include a red color filter, a blue color filer, and a blue color filter.

The left pixel PX and the right pixel RP may share the white subpixel WP. In more detail, the white subpixel WP may display a part of first white data of the left pixel data including information about an image to be expressed through the left pixel LP, and a part of second white data of the right pixel data including information about an image to be expressed through the right pixel RP.

To this end, the left pixel data may be divided into first white data and first color data, and the right pixel data may be divided into first white data and second color data. The first color data may be displayed through a red subpixel RPX, a green subpixel GPX, and a blue subpixel BPX of the left pixel LP, while the second color data may be displayed through a red subpixel RPX, a green subpixel GPX, and a blue subpixel BPX of the left pixel LP.

In this manner, as the left pixel LP and the right pixel RP share the white subpixel WP and the white subpixel WP displays an image corresponding to the first and second white data, the display panel 400 (e.g., shown in FIG. 1) may be improved in luminance (i.e., the luminance of the display panel 400 may increase).

The left pixel LP and the right pixel RP may be, for example, shaped in squares. The white subpixel WP may be shaped in a rectangle. For example, the white subpixel WP may include a short side that is parallel with the first direction DR1, and a long side that is parallel with the second direction DR2. The long side of the white subpixel WP may be identical to a side of the right pixel RP in length. A ratio between the long side of the white subpixel WP and the short side of the white subpixel may be about 3:1.

The red subpixel RPX, the green subpixel GPX, and the blue subpixel BPX may be shaped in the same manner as the white subpixel WP.

Each of the red subpixel RPX, the green subpixel GPX, and the blue subpixel BPX may include a first circuit area CA and a first electrode area EA. The first circuit area CA may be isolated from the first electrode area EA in the second direction DR2.

In the first electrode area EA, a first electrode AE (see, e.g., FIG. 6) may be provided, and a device driving circuit DDC (see, e.g., FIG. 6) may be provided to process a data voltage in response to a gate signal, which is applied thereto, and supply the processed data voltage to the first electrode AE. The first electrode AE and the device driving circuit DDC will be described in further detail later in conjunction with FIG. 6.

The white subpixel WP may include a second circuit area CW, a second electrode area EW, and a device embedded area DEA. The second circuit area CW may be isolated from the second electrode area EW and the device embedded area DEA in the second direction DR2. Additionally, the device embedded area DEA and the second electrode area EW may be isolated from each other in the first direction DR1.

In the second electrode area EW, a white pixel electrode may be provided, and a device driving circuit DDC may be provided to process a data voltage in response to a gate signal, which is applied thereto, and supply the processed data voltage to the white pixel electrode. The second circuit area CW and the first circuit area CA may be shaped in the same manner. The second electrode area EW may be narrower than the first electrode area EA in area.

The in-pixel element IPE may be exemplarily provided to the device embedded area DEA. The in-pixel element IPE may not be otherwise provided to the red subpixel RPX, the green subpixel GPX, and the blue subpixel BPX. The in-pixel element IPE may be formed of the in-pixel data driver units IGD1~IGDn.

On the other hand, the white subpixel WP may be narrower than the red subpixel RPX, the green subpixel GPX, and the blue subpixel BPX in visible angle. As the visible angle decreases, color coordinates of a white image displayed in the white subpixel WP may relatively change to make the white image closer toward yellow. In other words, the white image may become yellowish. Therefore, if the white subpixel WP is enhanced in contribution, the display panel 400 may degrade in image quality.

In an embodiment of the inventive concept, as the in-pixel element IPE is provided only to the white subpixel WP, only an opening rate of the white subpixel WP may be wasted, but maintaining opening rates of the red subpixel RPX, the green subpixel GPX, and the blue subpixel BPX, to implement the in-pixel gate driver. Additionally, the opening rate of the white subpixel WP and the contribution of the white subpixel WP become lower to effectively prevent degradation of an image, which is displayed by the white subpixel WP in the display panel 400.

While FIG. 3 illustrates the white subpixel WP forming one pixel group PG together with the two left and right pixels LP and RP, embodiments of the inventive concept may not be restricted hereto. For example, the white subpixel WP may form one pixel together with one of the red subpixel RPX, the green subpixel GPX, and the blue subpixel BPX. Otherwise, the red subpixel RPX, the green subpixel GPX, and the blue subpixel BPX may form one pixel. Additionally, two pixels each made of two subpixels may be shared by one of the white subpixel WP.

Figure 4:
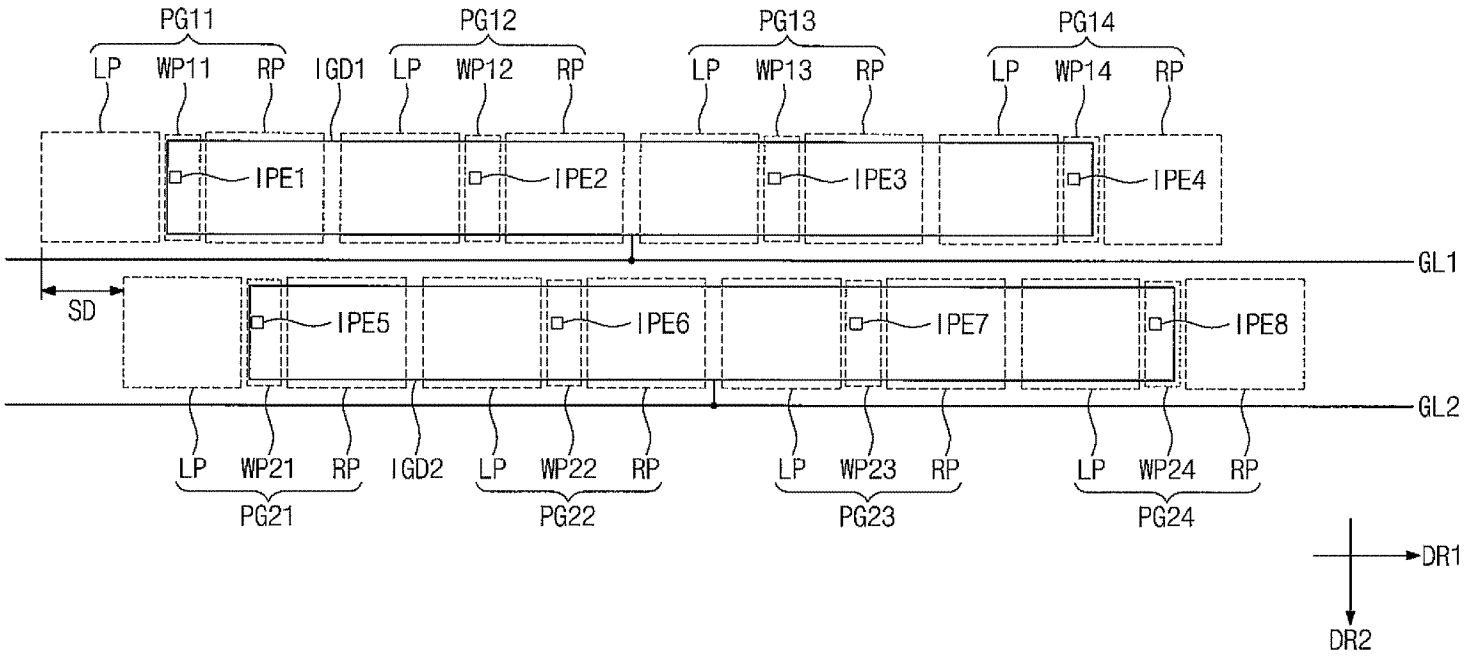
FIG. 4 is an enlarged plan view illustrating a part of the in-pixel gate driver units shown in FIG. 1.

FIG. 4 is an enlarged plan view illustrating a part of the in-pixel gate driver units shown in FIG. 1.

In FIG. 4, the leftmost one of the first in-pixel gate driver units IGD1 and the leftmost one of the second in-pixel gate driver units IGD2 are shown for ease of illustration.

For convenience of description, a pixel group disposed on an i'th row and a j'th column may be indicated and referred to as an ij'th pixel group PGij hereinafter. Similarly, a white subpixel disposed in the ij'th pixel group PGij may be indicated and referred to as an ij'th white subpixel WPij.

In an embodiment, the first in-pixel gate driver unit IGD1 may include first to fourth in-pixel elements IPE1~IPE4. The first to fourth in-pixel elements IPE1~IPE4 may be distributed in the 11'th, 12'th, 13'th, and 14'th pixel groups PG11, PG12, PG13, and PG14, which are arranged in the first direction DR1 along the first gate line GL1. In more detail, the first to fourth in-pixel elements IPE1~IPE4 may be respectively included in 11'th, 12'th, 13'th, and 14'th white subpixels WP11, WP12, WP13, and WP14.

The second in-pixel gate driver unit IGD2 may include fifth to eighth in-pixel elements IPE5~IPE8. The fifth to eighth in-pixel elements IPE5~IPE8 may be distributed in the 21'th, 22'th, 23'th, and 24'th pixel groups PG21, PG22, PG23, and PG24, which are arranged in the first direction DR1 along the second gate line GL2. In more detail, the fifth to eighth in-pixel elements IPE5~IPE8 may be respectively included in 21'th, 22'th, 23'th, and 24'th white subpixels WP21, WP22, WP23, and WP24.

The 21'th, 22'th, 23'th, and 24'th pixel groups PG21, PG22, PG23, and PG24 may be shifted by a shift distance SD toward the first direction DR1 in comparison with the 11th, 12'th, 13'th, and 14'th pixel groups PG11, PG12, PG13, and PG14. In an embodiment, the shift distance SD may correspond to about two subpixel widths. In more detail, the center of the 1j'th white subpixels WP1*j* may be placed on an imaginary line, which crosses the center of the left pixel LP of the 2j'th pixel group PG2*j*, and is parallel with the second direction DR2.

While each of the first and second in-pixel gate driver units IGD1 and IGD2 is illustrated as being formed of four in-pixel elements, the inventive concept may not be restricted hereto in embodiments. Each of the first and second in-pixel gate driver units IGD1 and IGD2 may be formed of three or less in-pixel elements, or five or more in-pixel elements.

Figure 5:
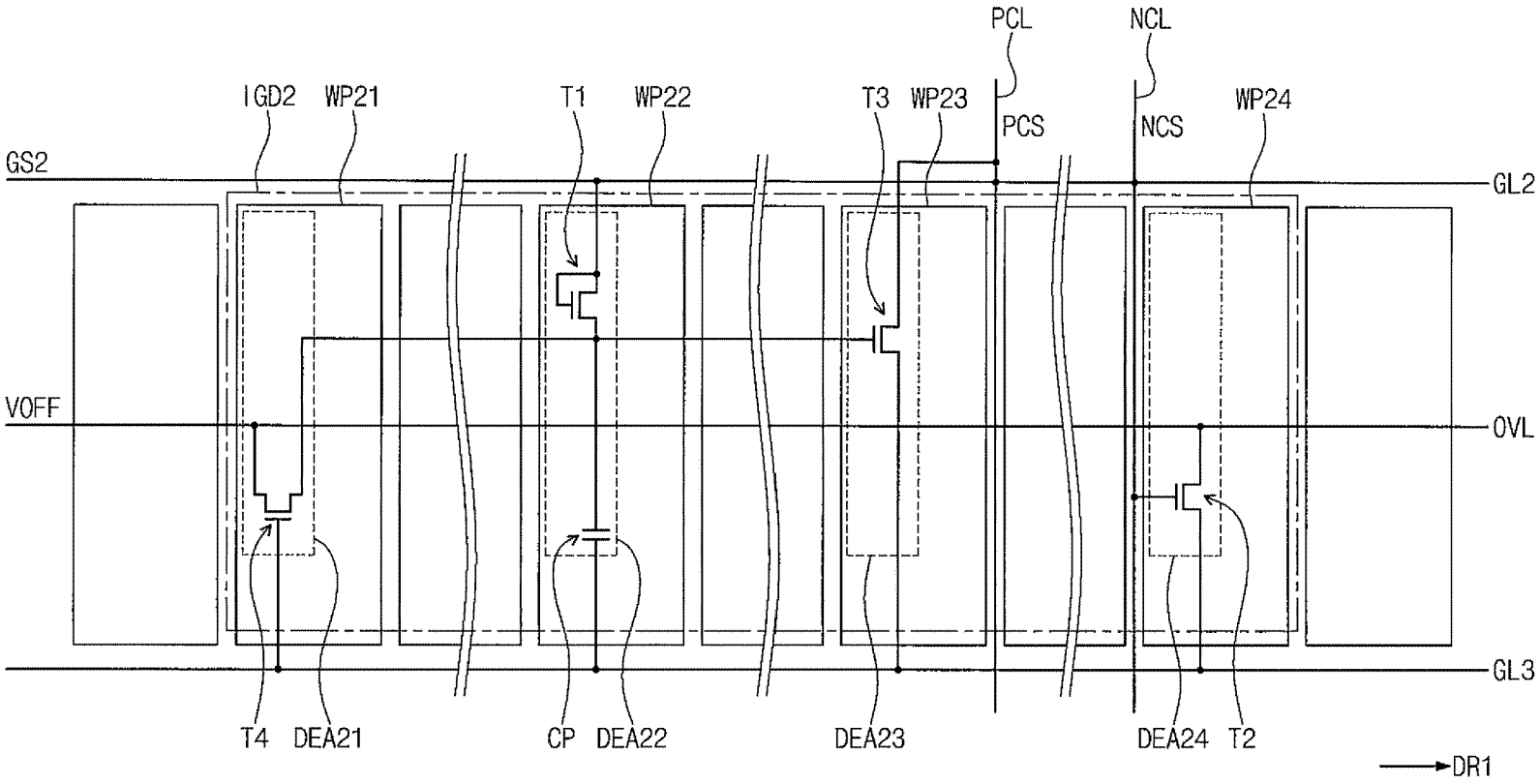
FIG. 5 is a circuit diagram exemplarily illustrating the second in-pixel gate driver unit shown in FIG. 4.

FIG. 5 is a circuit diagram exemplarily illustrating the second in-pixel gate driver unit shown in FIG. 4.

Referring to FIG. 5, in an embodiment, each of the fifth to eighth in-pixel elements IPE5~IPE8 of the second in-pixel gate driver unit IGD2 may include a transistor and/or a capacitor.

In an embodiment, the sixth in-pixel element IPE6 (e.g., shown in FIG. 4) may include a first transistor T1 and a capacitor CP. The first transistor T1 may include a gate electrode and a source electrode that is connected with the second gate line GL2, and a drain electrode that is connected with a middle node MN. The capacitor CP may include one end that is connected with the middle node MN, and the other end that is connected to the third gate line GL3. The first transistor T1 and the capacitor CP may be provided into a device embedded area DEA22 of the 22'th white subpixel WP22. The first transistor T1 may supply the second gate signal GS2, which is received from the second gate line GL2.

In an embodiment, the eighth in-pixel element IPE8 (e.g., shown in FIG. 4) may include a second transistor that has a gate electrode connected with the negative clock line NCL, a source electrode connected with the off-voltage line OVL, and a drain electrode connected with the third gate line GL3. The second transistor T2 may be provided into a device embedded area DEA24 of the 24'th white subpixel WP24. The second transistor T2 may output the off-voltage VOFF to the third gate line GL3 in response to the negative clock signal NCS.

The off-voltage line OVL, for example, may be extended toward the first direction DR1 and provided between the first and second lines GL1 and GL2.

In an embodiment, the seventh in-pixel element IPE7 (e.g., shown in FIG. 4) may include a third transistor T3 that has a gate electrode connected with the middle node MN, a source electrode connected with the positive clock line PCL, and a drain electrode connected with the third gate line GL3. The third transistor T3 may be provided into a device embedded area DEA23 of the 23'th white subpixel WP23. The third transistor T3 may output the positive clock signal PCS to the third gate line GL3 in response to a signal applied to the middle node MN.

In an embodiment, the fifth in-pixel element IPE5 (e.g., shown in FIG. 4) may be a first transistor that includes a gate electrode connected with the third gate line GL3, a source electrode connected with the off-voltage line OVL, and a drain electrode connected with the middle node MN. The fifth in-pixel element IPE5 may be included in a device embedded area DEA21 of the 21'th white subpixel WP21. A fourth transistor T4 may be provided into the device embedded area DEA21 of the 21'th white subpixel WP21. The fourth transistor T4 may output the off-voltage VOFF to the third gate line GL3 in response to the negative clock signal NCS.

Figure 6:
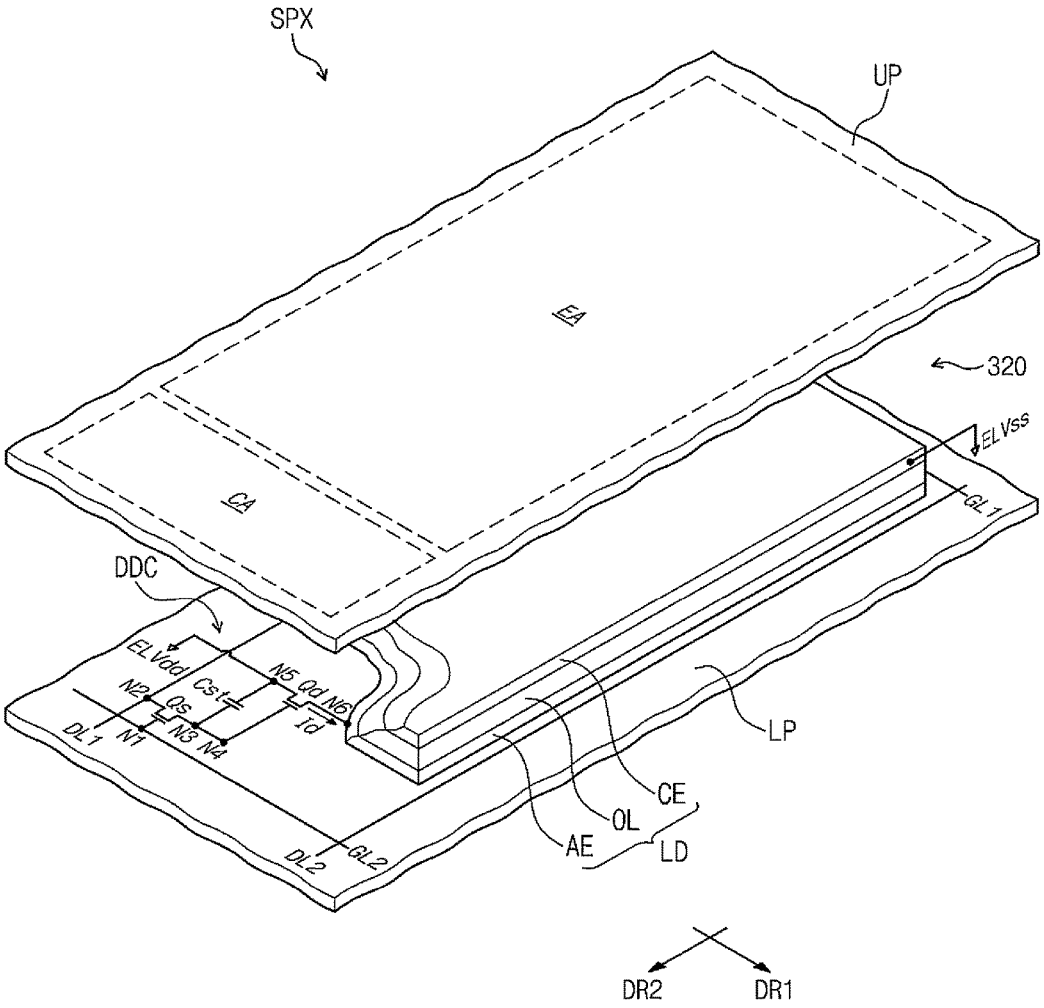
FIG. 6 is a schematic view illustrating a structure of the subpixel shown in FIG. 1.

FIG. 6 is a schematic view illustrating a structure of the subpixel shown in FIG. 1.

In FIG. 6, one of the subpixels SPX shown in FIG. 1 is illustrated as being connected with the first gate line GL1 and the first data line DL1.

The subpixel SPX may include an organic light emitting device LD and a device driving circuit DDC. The organic light emitting device LD and the device driving circuit DDC may be formed between a lower substrate LS and an upper substrate YS in the display panel 400 (e.g., shown FIG. 1).

Additionally, the subpixel SPX may include a barrier film for protecting the organic light emitting device LD from external foreign matters such as moisture or oxygen. The barrier film may encapsulate the organic light emitting device LD to prevent the organic light emitting device LD from being disclosed outward.

The barrier film may be implemented in a sealing member, which joins the upper substrate US and the lower substrate LS, or may be implemented in a thin-film encapsulation layer, which covers the inorganic light emitting device LD. The thin-film encapsulation layer may be formed of a single layer that is made of an organic film and/or an inorganic film, or a plurality of layers that are made of an organic film and/or an inorganic film.

The device driving circuit DDC may include a switching transistor Qs, a driving transistor Qd, and a storage capacitor Cst.

The switching transistor Qs may include a control node N1, an input node N2, and an output node N3. The control node N1 may be connected with the first gate line GL1, the input node N2 may be connected with the first data line DL1, and the output node N3 may be connected with the driving transistor Qd. The switching transistor Qs may output a data voltage, which is applied to the first data line DL1, to the driving transistor Qd in response to a gate signal that is applied to the first gate line GL1.

The driving transistor Qd may include a control node N4, an input node N5, and an output node N6. The control node N4 may be connected with the output node N3 of the switching transistor Qs, the input node N5 may receive a driving voltage ELVdd, and the output node N6 may be connected with the organic light emitting device LD. The driving transistor Qd may supply an output current Id, which varies depending on a voltage between the control node N4 and the output node N6, into the organic light emitting device LD.

The storage capacitor Cst may be connected between the output node N3 of the switching transistor Qs and the input node N5 of the driving transistor Qd. The storage driving transistor Qd may charge a data voltage that is applied to the control node N4 of the driving transistor Qd, and maintain the charged data voltage for a time after the switching transistor Qs is turned off.

The lower substrate LS may further include a driving voltage line. The driving voltage line may extend in parallel with the first gate line GL1 or the first data line DL1. The driving voltage line may receive the driving voltage ELVdd and may be connected with the input node N5 of the driving transistor Qd.

The organic light emitting device LD may include a first electrode AE, an organic layer OL, and the second electrode CE.

The first electrode AE may be an anode electrode. The first electrode AE may connect with the output node N6 of the driving transistor Qd and provide holes into the organic layer OL. The second electrode CE may be a cathode electrode. The second electrode CE may receive a common voltage ELVss and provide electrons into the organic layer OL. The organic layer OL may be disposed between the first electrode AE and the second electrode CE. The organic layer OL may be formed of a plurality of layers, including an organic material.

Holes and electrons may be injected into the organic layer OL from the first electrode AE and the second electrode CE. In the organic layer OL, such holes and electrons are combined to form excitons. Light is emitted when the excitons transitions from an excited state to a ground state. Intensity of light emitted from the organic layer OL may be determined by the output current Id flowing through the output node N6.

While FIG. 6 exemplarily illustrates the second electrode CE being disposed on the first electrode AE, embodiments of the inventive concept may not be restricted hereto. The first electrode AE and the second electrode CE may be changed (e.g., swapped) in position.

The first electrode AE may be provided in correspondence with the first electrode area EA. The device driving circuit DDC may be provided in correspondence with the first circuit area CA.

While an internal cavity 320 defined by the lower substrate LS and the upper substrate US may be formed by a vacuum, embodiments of the inventive concept may not be restricted hereto. For example, the internal cavity 320 may be filled with an inert gas such as nitrogen N2, or a tamping member such as an insulation material.

The organic light emitting device LD may include an optical compensation layer. The optical compensation layer may help light, which is emitted from the organic layer OL, to disperse with a wide emitting angle, or increase light extraction efficiency of the organic light emitting device LD.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "upper", and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While the inventive concept has been described with reference to exemplary embodiments, it will be apparent to those skilled in the art that various suitable changes and modifications may be made without departing from the spirit and scope of the inventive concept set forth throughout the annexed claim matters. Therefore, it should be understood that the above embodiments are not limiting, but illustrative, hence all technical things within the annexed claims and the equivalents thereof may be construed as properly belonging to the territory of the inventive concept.

What is claimed is:

1. A display panel comprising:

a plurality of white subpixels configured to display a white image;

a gate line connected with the white subpixels and extended in a row direction;

an in-pixel gate driver comprising in-pixel elements exclusively in the white subpixels and connected with the gate line to supply a gate signal to the gate line; and a plurality of color subpixels connected to the gate line and configured to be driven by the gate signal.

2. The display panel according to claim 1, wherein the gate line comprises first to n'th gate lines, and wherein the in-pixel gate driver comprises first to n'th in-pixel gate driver units that supply corresponding gate signals of the gate signal to the first to n'th gate lines, where n is a natural number larger than or equal to 2.

3. The display panel according to claim 2, wherein each of the first to n'th in-pixel gate driver units comprises p members, where p is a natural number larger than or equal to 2.

4. The display panel according to claim 1, wherein the in-pixel gate driver comprises a plurality of in-pixel gate driver units provided along the row direction.

5. The display panel according to claim 4, wherein each of the plurality of in-pixel gate driver units comprise members corresponding to k subpixels in the row direction, where k is a natural number.

6. The display panel according to claim 5, wherein k is determined from characteristics of the gate line.

7. The display panel according to claim 1, further comprising a plurality of pixel groups, wherein each of the pixel groups comprise a white subpixel of the white subpixels and a plurality of pixels, each of the pixels having corresponding color subpixel of the plurality of color subpixels to display a color image.

8. The display panel according to claim 7, wherein a left pixel and a right pixel of the plurality of pixels are at opposite sides of the white subpixel.

9. The display panel according to claim 8, wherein the left pixel and the right pixel of each of the pixel groups are configured to share the white subpixel of each of the pixel groups.

10. The display panel according to claim 8, wherein each of the left and right pixels comprises a red subpixel, a green subpixel, and a blue subpixel respectively displaying a red image, a green image, and a blue image.

11. A display panel comprising:

a plurality of white subpixels configured to display a white image;

a gate line connected with the white subpixels and extended in a row direction; and an in-pixel gate driver comprising in-pixel elements exclusively in the white subpixels and connected with the gate line to supply a gate signal to the gate line, wherein the in-pixel elements are in a device embedded area of each of the white subpixels, and wherein each of the white subpixels comprises a white pixel electrode in an electrode area of each of the white subpixels, the electrode area not overlapping with the device embedded area.

12. The display panel according to claim 11, wherein each of the white subpixels comprises a device driving circuit in a circuit area of each of the white subpixels, and wherein the circuit area does not overlap with the device embedded area.

13. A display panel comprising:

a plurality of white subpixels configured to display a white image;

a gate line connected with the white subpixels and extended in a row direction; and an in-pixel gate driver comprising in-pixel elements exclusively in the white subpixels and connected with the gate line to supply a gate signal to the gate line, wherein the gate line comprises a first gate line and a second gate line adjacent to the first gate line in a column direction, and wherein the in-pixel gate driver is between the first and second gate lines, and is configured to use a first gate signal of the gate signal to generate a second gate signal of the gate signal, the first and second gate signals being received from the first and second gate lines, respectively.

14. The display panel according to claim 13, wherein the in-pixel elements comprise a first transistor connected with the first gate line and configured to supply the first gate signal.

15. The display panel according to claim 14, further comprising an off-voltage line configured to supply an off-voltage, wherein the in-pixel elements comprise a second transistor connected with the off-voltage line and configured to supply the off-voltage from the off-voltage line to the second gate line.

16. The display panel according to claim 15, further comprising:

a positive clock line configures to supply a positive clock signal; and a negative clock line configured to supply a negative clock signal having a phase reverse that of the positive clock signal, wherein the in-pixel elements comprise a third transistor that comprises a source electrode connected with the positive clock line and a drain electrode connected with the second gate line, and wherein the second transistor comprises a gate electrode connected with the negative clock line, a source electrode connected with the off-voltage line, and a drain electrode connected with the second gate line.

17. The display panel according to claim 16, wherein the off-voltage line is parallel with the row direction, and wherein the positive and negative clock lines are parallel with the column direction.

* * * * *